US005762180A

United States Patent [19]

Pomatto et al.

[11] Patent Number: 5,762,180

[45] Date of Patent: Jun. 9, 1998

[54] RETROFIT SWITCH ACTUATOR

[75] Inventors: Lawrence A. Pomatto, Santa Ana; Ronald Bruce Tinkham, Solano Beach, both of Calif.

[73] Assignee: System Analysis and Integration, Inc., Orange, Calif.

[21] Appl. No.: 615,592

[22] Filed: Mar. 12, 1996

[51] Int. Cl.[6] ..... H01H 3/20

[52] U.S. Cl. ..... 200/330; 200/331

[58] Field of Search ..... 200/330, 328, 200/331, 332.1, 377; 335/174, 173, 172

[56] References Cited

U.S. PATENT DOCUMENTS 4,167,659 9/1979 Yamanaka et al. ..... 200/329
4,227,059 10/1980 Ogawa ..... 200/337
4,292,612 9/1981 Howell ..... 335/173
5,179,376 1/1993 Pomatto ..... 340/870.02
5,475,190 12/1995 Smith et al. ..... 200/330

*Primary Examiner*—David J. Walczak
*Attorney, Agent, or Firm*—Knobbe, Martens, Olson & Bear, LLP

[57] ABSTRACT

A retrofit switch actuator for a circuit breaker control switch in a power distribution network provides for remote control and automation of the control switch. A solenoid of the switch actuator is energized to move the output shaft of the solenoid. The movement of the solenoid output shaft is converted into rotational motion by an adapter rotatably mounted at one end to the solenoid output shaft and fixedly mounted at the other end to the control shaft of the circuit breaker. The rotational motion of the control shaft mechanically engages the existing circuit breaker control switch.

5 Claims, 8 Drawing Sheets

RETROFIT SWITCH ACTUATOR

BACKGROUND OF THE INVENTION

1. Field of the Invention

The present invention relates to retrofitting a power substation circuit breaker control switch for automation and remote control. Specifically, a switch actuator is installed in the substation, leaving the existing circuit breaker control switch pistol grip control in place, to provide manual or remote control of the circuit breaker control switch.

2. Description of Related Art

Typically, power substations are monitored on-site by personnel that check panel indicator lights of a circuit breaker system to determine whether an alarm condition exists which requires opening the circuit. When an alarm condition is recognized, a crew member manually turns a pistol grip which operates the circuit breaker control switches. Once activated, the switches control a number of individual switching mechanisms within the circuit which ultimately open or close the circuit. By tripping the circuit, power distribution can be managed and harm to the system prevented.

In an effort to automate a power substation, one method proposed for controlling the circuits is to directly control the individual switching mechanisms using complex controls with new control components. However, automation proposals to date require replacement of the substation hardware.

SUMMARY OF THE INVENTION

The present inventor recognized the need for a more efficient and cost-effective automation system to control a power substation circuit breaker. By retrofitting existing circuit breaker control switches with an actuator, the existing circuit breaker control switches may be remote controlled. The existing mechanical handle may also remain.

The present invention substantially reduces costs for automation of the circuit breaker control system. One advantage of the present invention is that it does not require an entirely new circuit breaker control system, or changing the components of the substation. Therefore, installation does not cause power outage or require existing Control Wiring to be changed.

The retrofit switch actuator of the present invention comprises a solenoid having an axially movable output shaft and an adapter which converts movement along the axis of the solenoid output shaft into rotational motion to activate the circuit breaker control switch. In a preferred embodiment, the adapter is rotatably mounted at one end to the output shaft of the solenoid and fixedly mounted at the other end to the control shaft of the circuit breaker control system. Rotation of the control shaft is initiated by axial motion of the solenoid. Rotation of the control shaft simulates the motion created by manually rotating the pistol grip and, in turn, mechanically engages the circuit breaker control switch.

Advantageously, the solenoid is electrically linked to a control panel comprising power, ground, and trip and close signals for the solenoid. The control panel receives signals from the main monitoring system to energize and control the solenoid. When the solenoid is engaged, the output shaft or armature of the solenoid moves axially from a first solenoid position to a second solenoid position. In response to the movement of the solenoid output shaft via the adapter switch, the control shaft moves from a first rotational position to a second rotational position.

The present invention provides for both front and rear mounting positions. In rear mounting, the pistol grip of the circuit breaker system remains unmodified. In front mounting, a pistol grip adapter is inserted between an existing pistol grip and a switch mounting plate.

DETAILED DESCRIPTION OF THE PREFERRED EMBODIMENTS

Two preferred embodiments of the present invention are described below. A first embodiment, illustrated in FIGS. 1–6, comprises a retrofit switch actuator 100 rear mounted to an existing circuit breaker control switch 112. A second embodiment, shown in FIGS. 7–12, comprises a front mounted switch actuator attached between a pistol grip and a wall panel of a circuit breaker control system.

Figure 1:
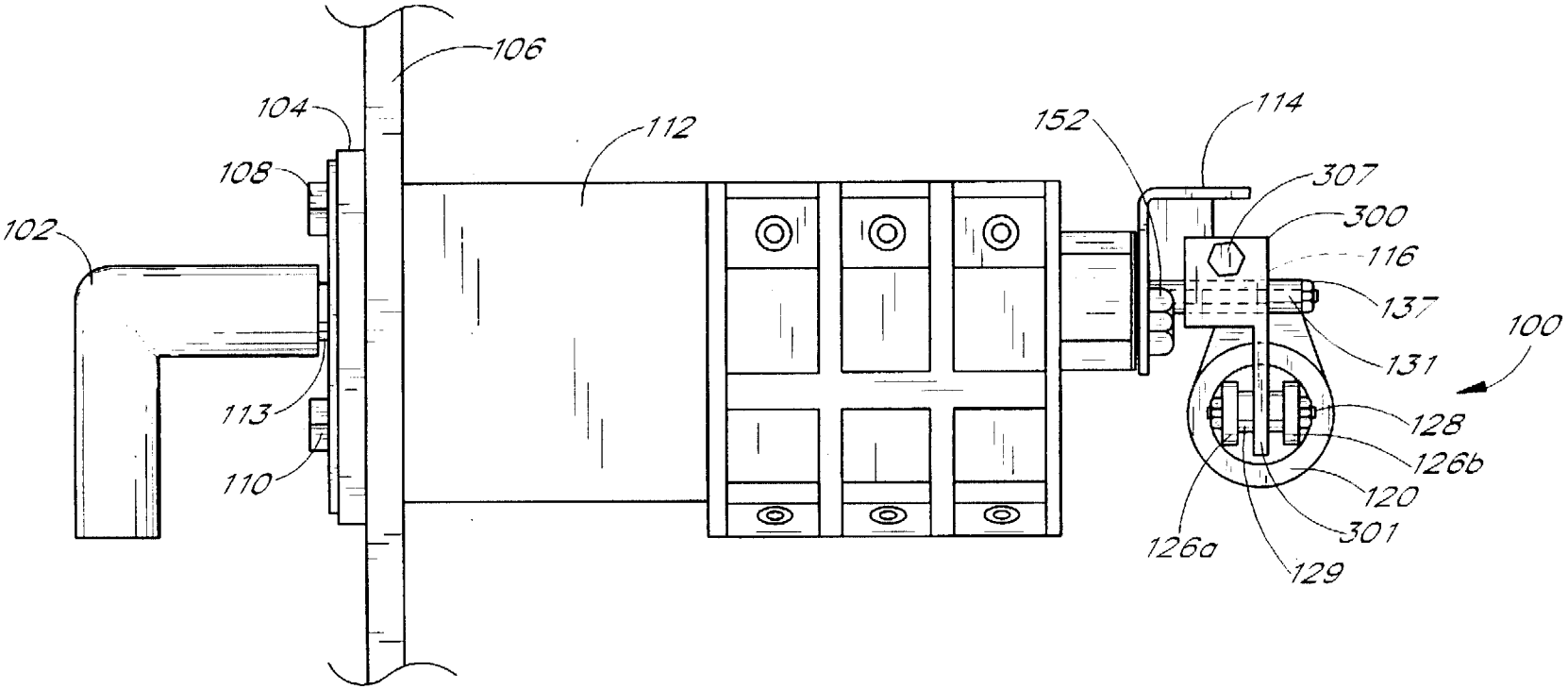
FIG. 1 depicts a front end view of a retrofit switch actuator rear mounted to a control switch in accordance with a first embodiment of the present invention.

A front end view of a retrofit switch actuator 100 according to a first embodiment (the rear mount embodiment) of the present invention is shown in FIG. 1. FIG. 1 illustrates the rear mounted retrofit switch actuator 100 for a circuit breaker control switch 112. The circuit breaker control switch 112 has a pistol grip 102 on a control shaft 113. A switch mounting plate 104 holds the control switch 112 in place on a wall panel 106. The switch actuator 100 has a solenoid bracket 114, a lever adapter 300 mounted upon a control shaft extension 116, and a bi-directional solenoid 120.

The pistol grip 102 of the circuit breaker control switch 112 is substantially cylindrical or oval in shape and forms an approximately 90 degree angle as known in the art. One portion of the pistol grip 102 is mounted on the circuit breaker control shaft 113 which extends from the control switch 112 through the wall panel 106 and through the switch mounting plate 104.

A plurality of switch mounting plate fasteners 108, 110 (such as bolts) pass through the mounting plate 104 and sandwich the wall panel 106 between the control switch 112 and the switch mounting plate 104. Advantageously, the fasteners which attach the mounting plate 104 to the wall panel 106 comprise bolts for the control switch 112. The bolts extend through the wall panel 106 and through the mounting plate 104.

The control switch 112 controls a power substation circuit breaker (not shown). To manually trip the circuit breaker via the control switch 112, the pistol grip 102 of the control switch is rotated from a first position to a second position. Rotation of the pistol grip rotates the control shaft 113 upon which the pistol grip is mounted. The rotation of the control shaft 113 triggers the control switch 112 of the circuit breaker. Once activated, the control switch 112 signals switching mechanisms within the circuit which ultimately open or close the circuit breaker.

In accordance with a first embodiment of the present invention, the switch actuator 100 is rear mounted to the circuit breaker control switch 112, as depicted in FIGS. 1 and 2. A solenoid bracket 114 is installed at the back end of the control switch 112 over a control shaft extension 116 of the control switch shaft 113. The shaft extension 116 protrudes from the rear of the control switch 112.

Figure 2A:
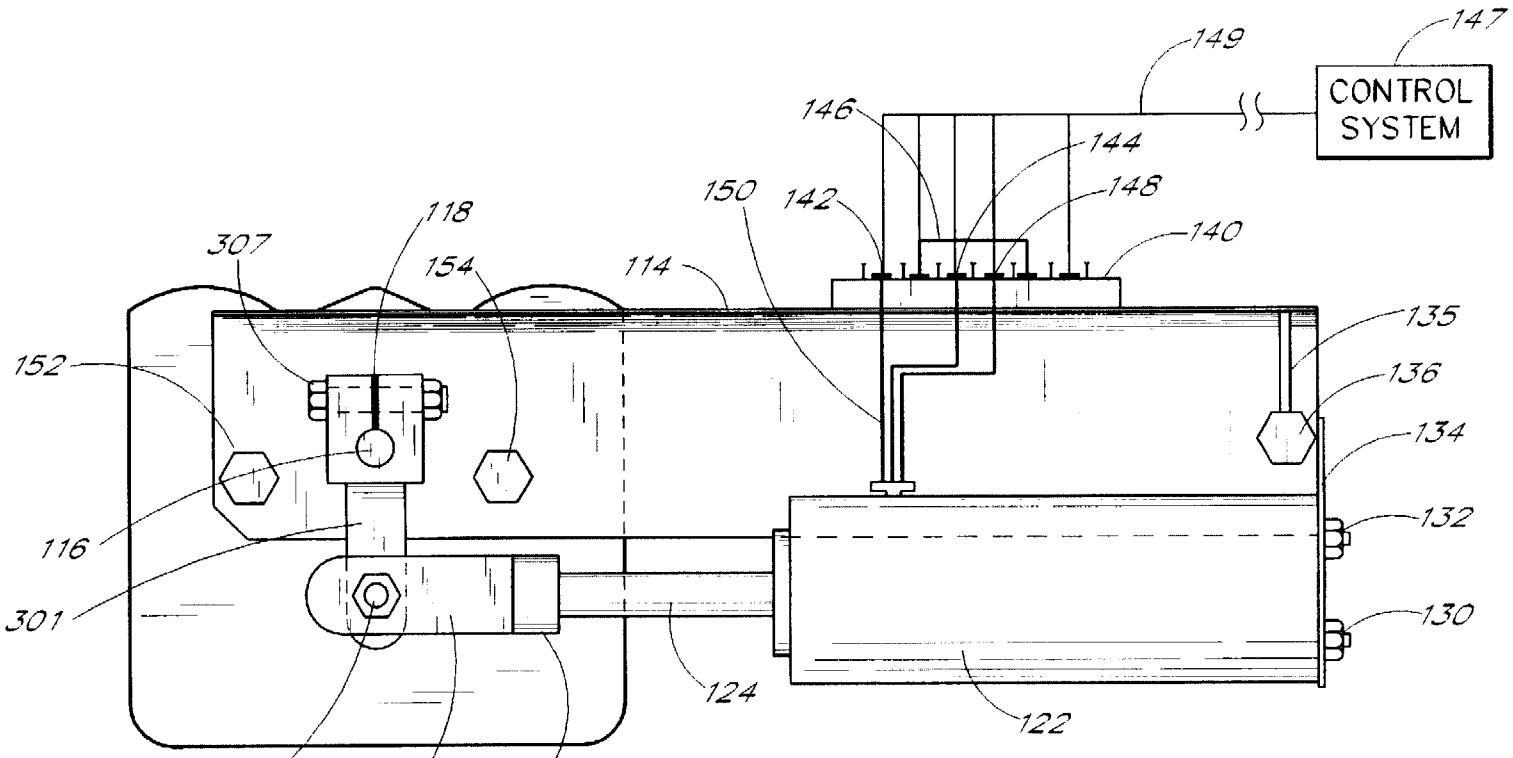
FIG. 2*a* is a side view of the embodiment of the present invention shown in FIG. 1.
Figure 2B:
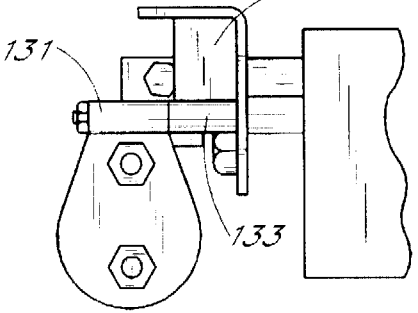
FIG. 2*b* depicts a back end view of the embodiment of the present invention shown in FIG. 1.
Figure 5:
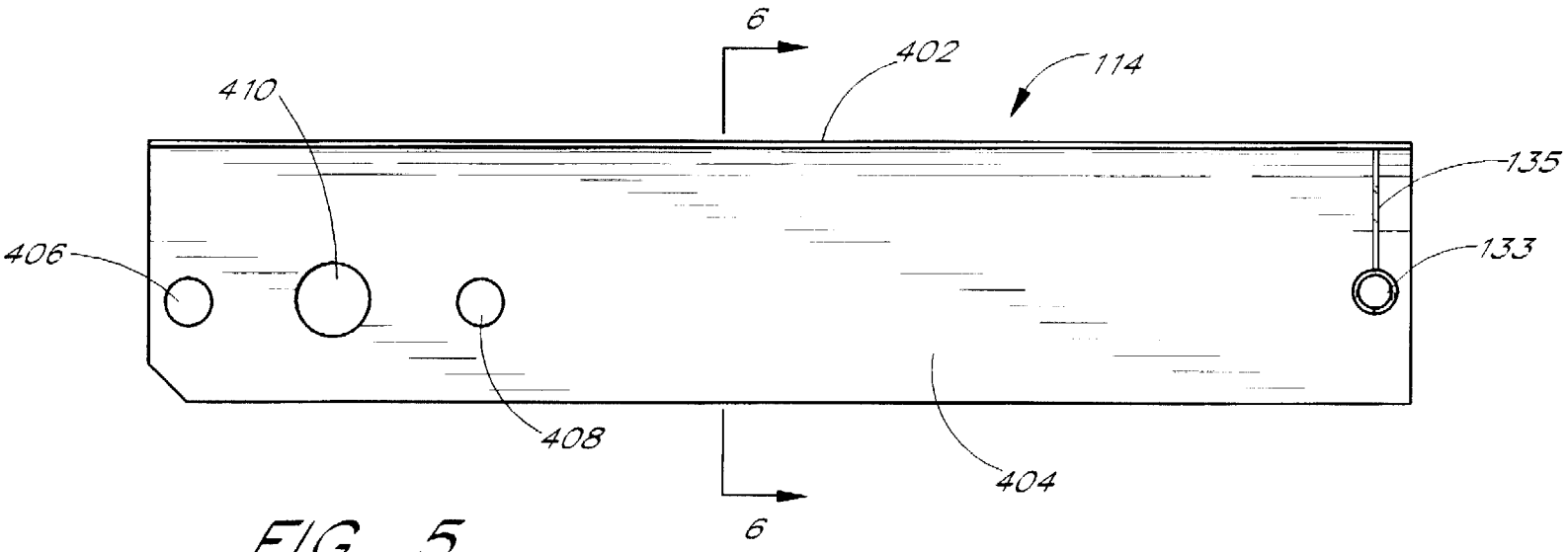
FIG. 5 depicts a side view of a solenoid bracket for the rear mounting embodiment of the present invention shown in FIG. 1.
Figure 6:
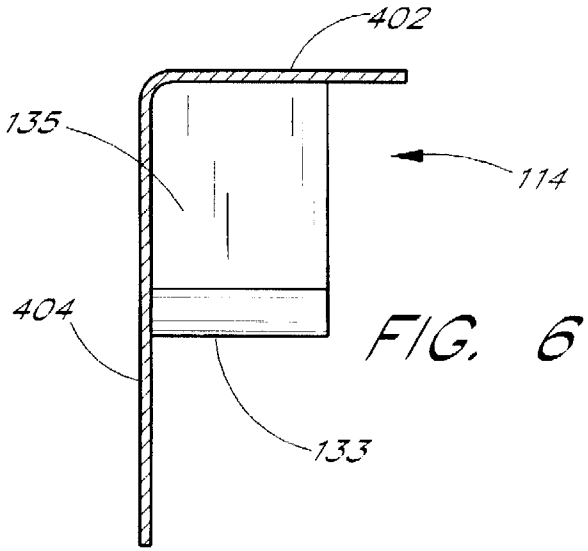
FIG. 6 is a cross-section of the solenoid bracket shown in FIG. 5.

The solenoid bracket 114 is illustrated in additional detail in FIGS. 5 and 6. The solenoid bracket 114 is rectangular in shape from a side view (FIG. 5) and has an L-shaped cross-section as seen in FIG. 6. The bracket is easily formed from stock, angle iron, angle aluminum or other high strength composite. The solenoid bracket 114 has mounting bolt through holes 406, 408, and shaft extension through hole 410. The mounting bolt through holes 406, 408 are for mounting bolts 152, 154 (FIG. 2*a*). The shaft extension through hole 410 is for the control switch extension shaft 116. The solenoid bracket 114 also has an internally threaded fixed sleeve portion 133 of a sleeve pivot for mounting the solenoid. A brace 135 is welded or otherwise bonded to the solenoid bracket 114 and to the fixed sleeve portion 133 to brace the fixed portion 133. The L-shape is formed by an upper plate 402 and a mounting plate 404 which form a 90° angle.

The solenoid bracket 114 attaches to the rear of the circuit breaker control switch 112 via the mounting bolts 152, 154 (FIG. 2*a*). The mounting bolt through holes 406, 408 accommodate the mounting bolts 152 and 154 which attach the solenoid bracket 114 to the existing circuit breaker control switch. The mounting bolts 152, 154 extend through the solenoid bracket apertures 406 and 408 and into the control switch 112.

The mounting portion 404 of the solenoid bracket further has the fixed sleeve portion 133 for the pivot 136 (FIG. 2*a*). The pivot 136 is additionally supported by the upper plate 402 of the solenoid bracket 114 via the brace plate 135.

Figure 3:
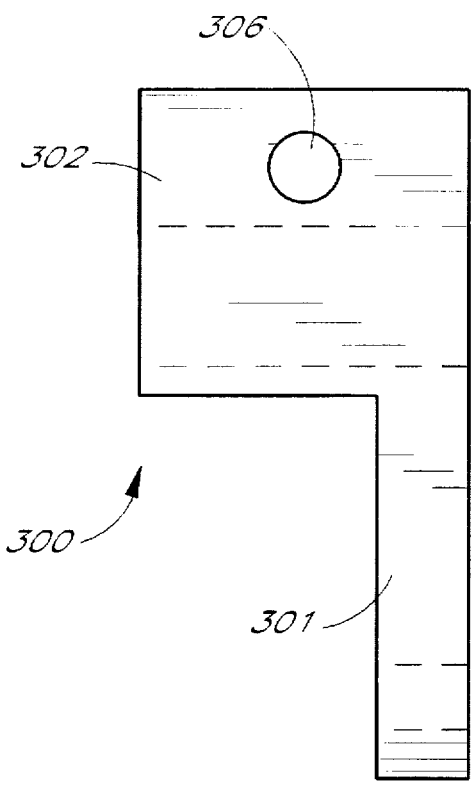
FIG. 3 depicts a side view of a lever adapter for the rear mounting embodiment of the present invention shown in FIG. 1.
Figure 4:
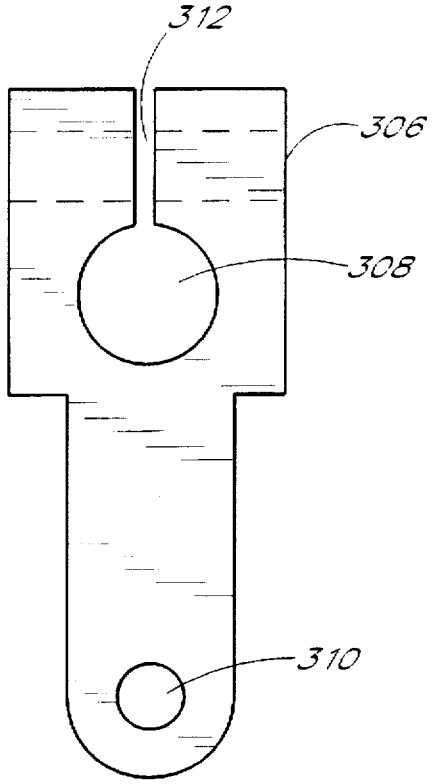
FIG. 4 depicts an end view of the lever adapter of FIG. 3.

Once the solenoid bracket 114 is mounted, the lever adapter 300 is mounted onto the control shaft extension 116. A detailed illustration of the adapter 300 from the side view and end view is shown in FIGS. 3 and 4, respectively. The lever adapter 300, shown in FIG. 3, has a block portion 302 with an extension leg 301. The block portion 302 of the adapter contains a shaft bore 308 through which the adapter 300 is mounted onto the control shaft extension 116. Therefore, the diameter of the shaft bore 308 is similar in size to the diameter of the control shaft extension 116.

The FIG. 3 side view of the adapter 300 illustrates a clamp bore 306 on the block portion 302 of the adapter 300. In a preferred embodiment, the clamp bore 306 accommodates a tightening connector, such as a tightening bolt 307 (FIG. 2). Located on the adapter 300 just above the shaft bore 308 is a clamp slit 312 which allows the diameter of the shaft bore 308 to be adjusted with force exerted on the tightening bolt 307 of the adapter 300. The adapter 300 mounts onto the control shaft extension 116 and the tightening bolt 307 is inserted through the clamp bore 306. Tightening of the tightening bolt 307 causes the slit 312 to contract which clamps the adapter securely on the control shaft extension 116. Removal of the adapter 300 from the control shaft extension 116 is through loosening of the tightening bolt 307.

The leg extension 301 of the adapter 300 has an armature clip connection bore 310. An armature clip 126 (FIGS. 1 and 2*a*) of the solenoid 120 is attached to the extension leg 301 of the adapter 300. The armature clip 126 is fixed to the end of the armature 124 and connects the armature 124 of the solenoid to the lever adapter 300. The armature clip 126 is a fork-like extension with two arms 126*a*, 126*b* (FIG. 1) that are constructed to straddle the extension leg 301 of the adapter 300. Advantageously, a bushing 129 or the like is positioned between the arms 126*a*, 126*b* of the armature clip 126 with a fixing bolt 128 or the like, which passes through a bore through the center cylindrical axis of the bushing and through apertures in the armature clip arms 126*a*, 126*b*. The armature connection bore 310 (FIG. 4) through the adapter 300 is constructed such that the bushing 129 passes through the armature connection bore 310. In one advantageous embodiment, the bushing 129 is made from a metal, fiber or other composite material which provides for smooth pivot action between the armature connection bore 310 and the bushing 129. The armature clip 126 of the solenoid is in this manner rotatably fixed to the lever adapter 300 by inserting a connector 128, such as a bolt or a pivot pin or the like, through both the armature clip 126 and the armature connection bore 310 of the leg extension 301.

Advantageously, the extending end of the armature 124 is threaded externally to accept an internally threaded portion 127 of the armature clip 126. The threads allow for easy adjustment of the effective length of the armature 124 to properly position the connection between the armature 124 and the adapter 300. Advantageously, when the solenoid is not energized, the adapter leg extension 301 and the armature clip 126 form a 90 degree angle. Upon energization of the solenoid, the angle formed by the adapter leg extension 301 and the armature clip 126 may be greater than or less than 90 degrees depending on the direction of the current flowing in the solenoid coil. In other words, the armature 124 of the solenoid is energized to travel axially away from the cylindrical portion 122 of the solenoid or into the cylindrical portion 122 of the solenoid depending upon the flow of current. Accordingly, the solenoid is a bi-directional solenoid which allows the control switches 112 to be activated or deactivated thereby opening or closing a corresponding circuit breaker.

As depicted in FIG. 2, the solenoid 120 has a cylindrical portion 122 which houses a coil (not shown) and the armature 124 or output shaft of the solenoid. In the preferred embodiment, the solenoid 120 is manufactured by Systems Integrated and operates on 24, 48, 120 or 220 volts AC or DC bi-directional, return to center solenoid. Electrical energy is required to move the armature 124 of the solenoid 120 to the extreme of either direction.

The cylindrical portion 122 of the solenoid is attached to a solenoid mounting plate 134 by bolts 130, 132. The solenoid mounting plate 134 is attached to the solenoid bracket 114 with a pivot 136. The pivot 136 is formed from a pivot sleeve 131 (FIGS. 1 and 2*b*) which is rigidly fixed to the solenoid mounting plate 134 and a pivot bolt 137 which passes through the pivot sleeve 131 and threads into the fixed sleeve portion 133 to affix the pivot sleeve 131 to the fixed sleeve portion 133 of the solenoid bracket 114. This connection allows for rotation of the solenoid about the pivot axis. Accordingly, the fixed sleeve portion 133 connected to the solenoid bracket 114 embraced with a brace plate 135 for rigidity forms a part of the pivot 136.

In an alternative embodiment, the pivot could be formed in a hinge fashion with two, three or more sleeve pieces with the brace plate 135 extending the length of the pivot with alternating sleeve portions connected to the brace plate 135 and the mounting plate 134.

The solenoid bracket 114, which is held in place with respect to the switch 112 by bolts 152 and 154, also supports a solenoid control panel 140. In the embodiment shown in FIG. 2, the solenoid control panel 140 is mounted on the upper portion 402 of the solenoid bracket 114.

The solenoid control panel 140 comprises a power signal line 148, a ground signal line 146, and trip and close signal lines 142 and 144, respectively. Signal lines 150 link the control panel 140 to the coil portion 122 of the solenoid. Control signals for the solenoid are provided by a control system 147 such as a computer or microcontroller based monitoring system with control outputs which are converted to analog signals sufficient to drive the control signals for the solenoid. Such a control system is shown and described in U.S. Pat. No. 5,179,376, assigned to the assignee of the present application, and incorporated herein by reference. Other control systems are also appropriate.

In the first embodiment of the present invention, the pistol grip 102 remains. Therefore, an operator can manually control the circuit breaker control switch 112 by rotating the pistol grip 102. Rotation of the pistol grip 102 rotates the control shaft 113, which operates the circuit breaker control switch 112.

For automatic control, when the control system 147 sends control signals to the switch actuator 100 of the present invention via control lines 149, the control panel 140 receives the signals. Signal lines 150 linking the control panel 140 to the solenoid 120 carry current to the solenoid coil to activate the solenoid 120. The signals on the open and close signal lines 142 and 144, respectively, control the direction of the flow of current through the solenoid 120. Depending on the direction of the current flowing through the coil, the armature 124 is either forced out of or drawn into the cylindrical portion 122 of the solenoid. Accordingly, the armature 124 and the armature clip 126 move along the axis of the solenoid 120.

Movement of the armature 124 causes the lever adapter 300 to rotate about an axis defined by the control switch extension shaft 116. Therefore, rotation of the adapter 300 rotates the control shaft extension 116 upon which the adapter 300 is mounted. The rotation of the control shaft extension 116 mechanically engages the control switch 112 for the circuit breaker control system. The circuit breaker control system thus reacts as if the pistol grip 102 had been manually operated.

FIGS. 7–12 depict a switch actuator made in accordance with a second embodiment of the present invention. In the second embodiment of the present invention, the switch actuator is front mounted onto an existing circuit breaker control switch 112.

Figure 7:
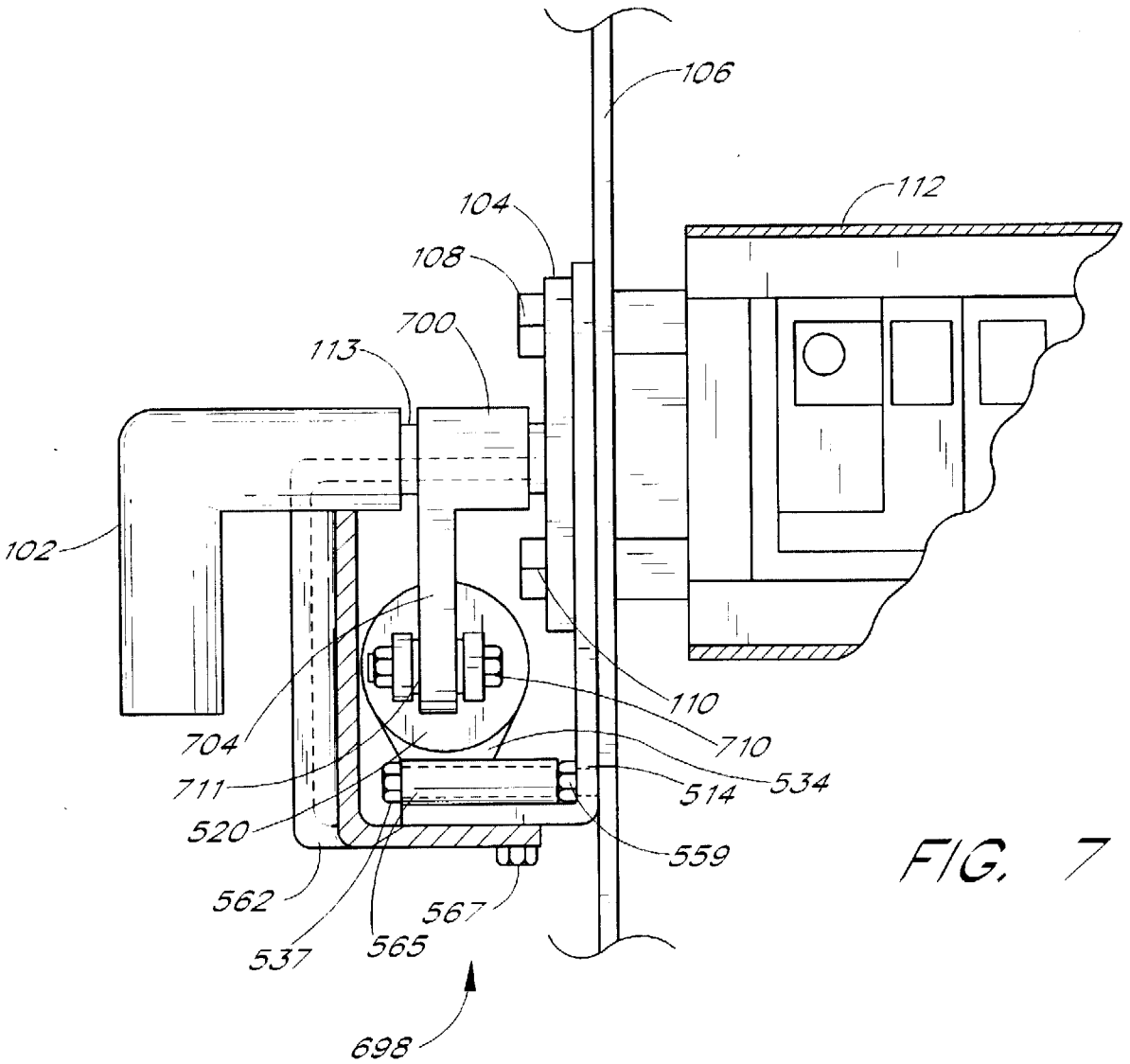
FIG. 7 depicts a front end view of a switch actuator front mounted in accordance with a second embodiment of the present invention.

FIG. 7 illustrates a front mounted switch actuator 698 for automating the manual circuit breaker control switch 112. As depicted in FIG. 7, the pistol grip 102 is mounted to the control switch shaft 113. As in the previous embodiment, the control switch 112 has the mounting plate 104 and the mounting bolts 108, 110 which sandwich the control panel wall 106 between the mounting plate 104 and the control switch 112. In the embodiment of the present invention depicted in FIG. 7, an adapter 700 is provided for connection to a bidirectional solenoid 520. The solenoid 520 mounts to a solenoid bracket 514. A cover 562 for the solenoid 520 is also advantageous.

Figure 8:
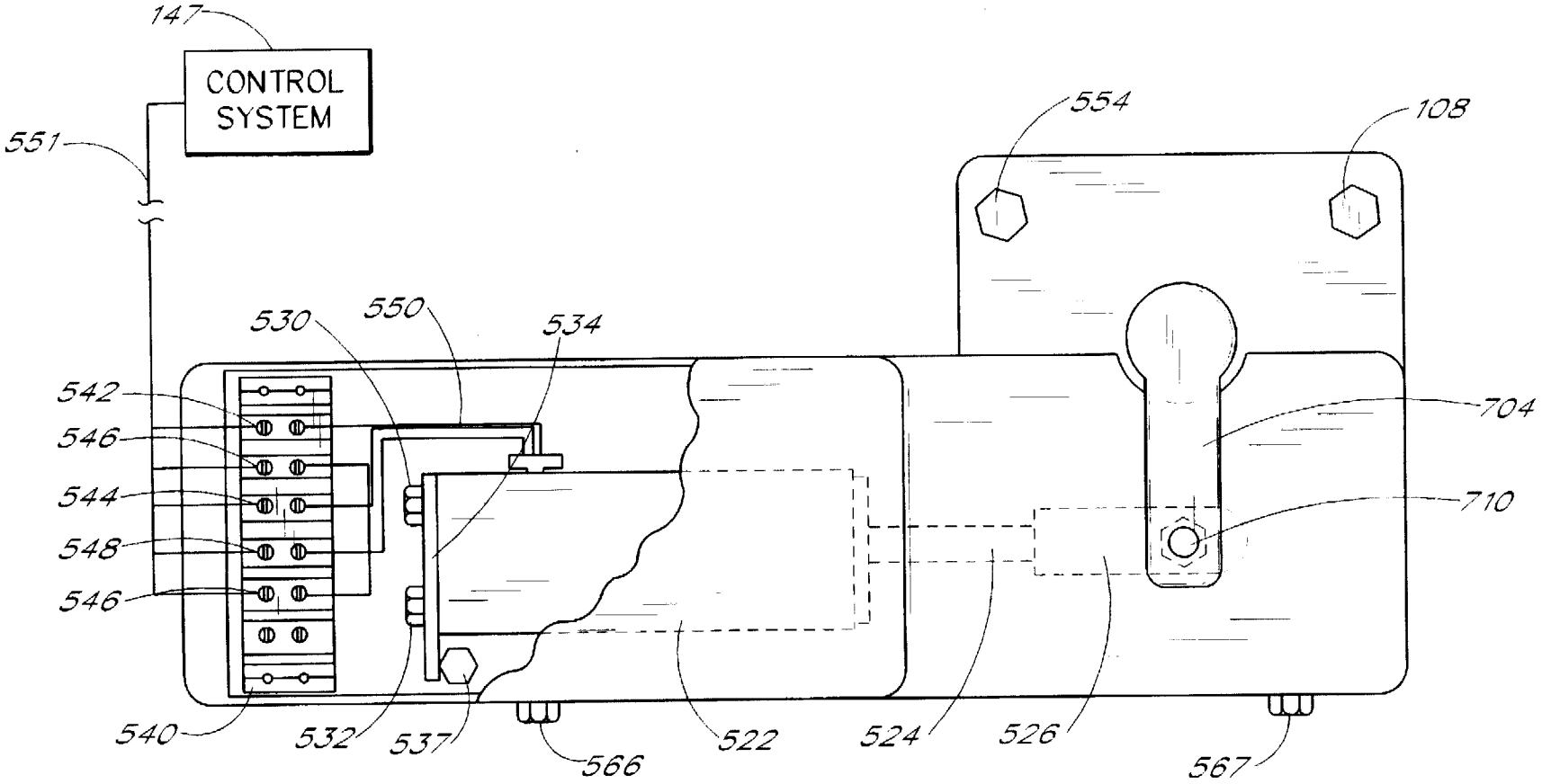
FIG. 8 is a side view of the front mounted embodiment of the present invention shown in FIG. 7.
Figure 9:
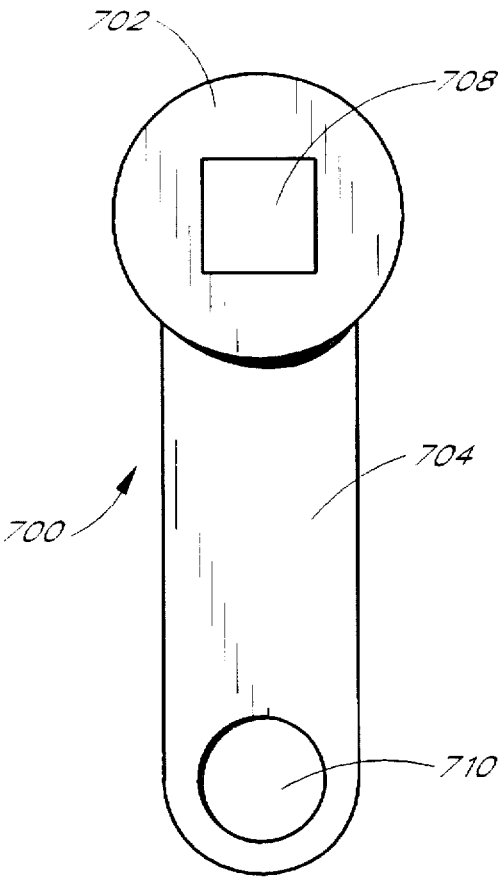
FIG. 9 depicts an adapter used in the front mounting embodiment of the present invention shown in FIG. 7.
Figure 10:
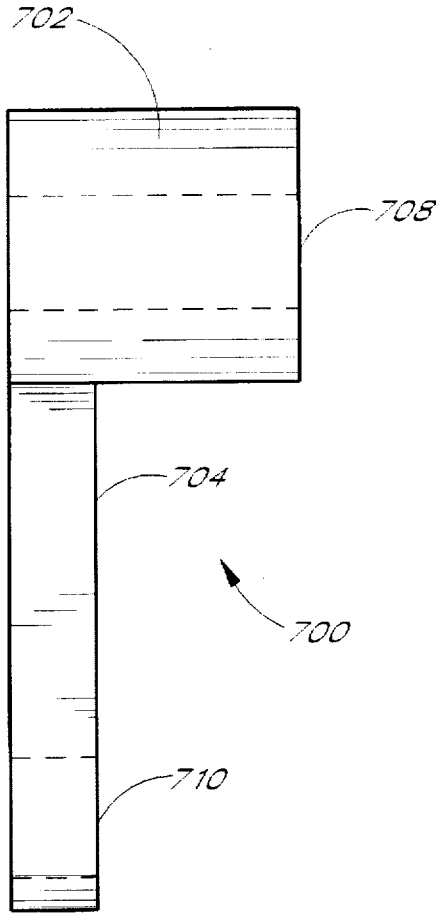
FIG. 10 depicts a side view of the adapter of FIG. 9.

FIG. 8 illustrates a side view of a switch actuator of the second embodiment of the present invention and will be discussed further below. FIG. 9 and 10 depict side and end views of the adaptor 700.

As illustrated in FIGS. 9 and 10, the adapter 700 comprises an upper block portion 702 with a lever arm 704. The block portion 702 of the adapter 700 is cylindrical in shape with a square thru-hole 708 in the present embodiment. The square thru-hole is sized to fit over the control shaft 113 without significant free-play. The lever arm 704 has a round armature clip connection thru-hole 710 in the present embodiment. It should be understood that the square thru-hole 708 is adapted for a square control switch shaft 113. However, the control switch shaft thru-hole 708 will be other shapes for control shafts having other shapes.

Figure 12:
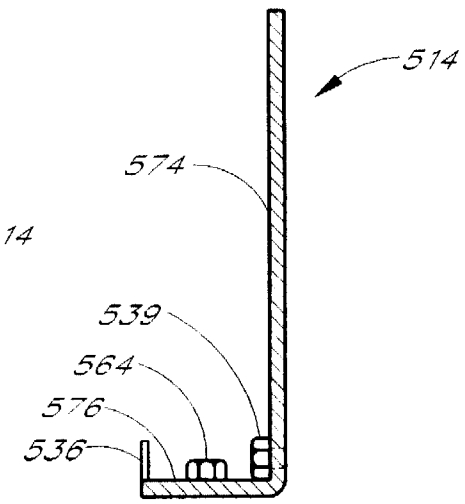
FIG. 12 is a cross-section of the solenoid bracket shown in FIG. 11.
Figure 11:
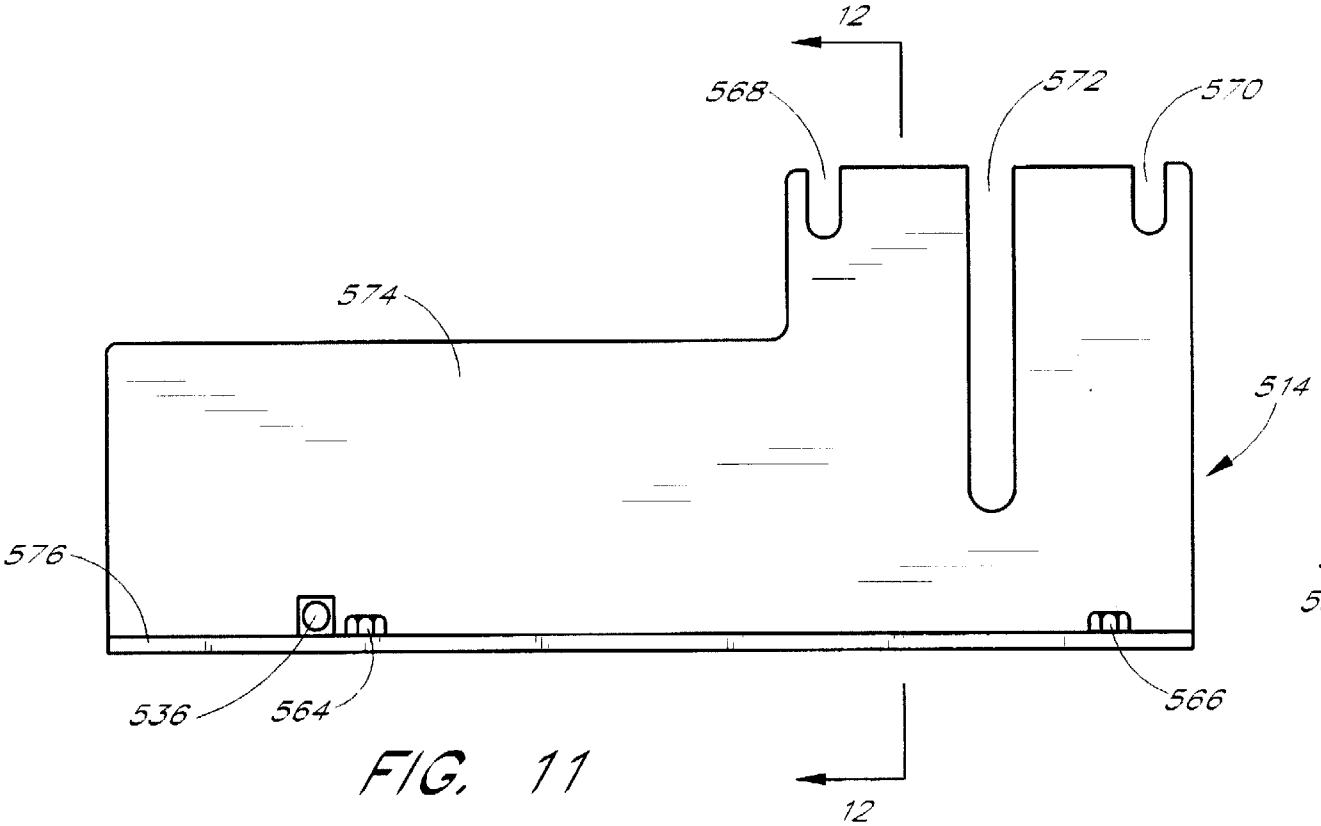
FIG. 11 depicts a side view of a solenoid bracket for front mounting the embodiment of the present invention depicted in FIG. 7.

FIGS. 11 and 12 depict a solenoid bracket 514 having an L-shaped cross-section, comprised of two sections, a mounting section 574 and a solenoid pivot section 576. The solenoid bracket 514 supports and protects the solenoid 520. The mounting portion 574 and the solenoid pivot portion 576 may be two pieces of material joined together or one continuous piece of material such as angle iron or a similar material as in the previous embodiment.

The mounting portion 574 of the solenoid bracket has mounting slots 568, 570, and an elongated switch shaft slot 572. These slots provide for ease of inserting the mounting portion 574 between the switch mounting plate 104 and the wall panel 106. The use of slots rather than holes avoids complete disassembly of the control switch mounting. However, in an alternative embodiment, holes could be used. The two short mounting slots 568 and 570 accommodate the switch bolts 108 and 554 (FIG. 8) that secure the solenoid bracket 514 to the wall panel 106. The number of slots on the solenoid bracket 514 varies according to the number of switch bolts used to secure the switch mounting plate 104 to the panel 106. The elongated slot 572 accommodates the control shaft 113 which protrudes from the wall panel 106 and a mounting bolt 110 (FIG. 7).

The solenoid bracket 514 also has cover nuts 564, 566 fixedly attached to the solenoid pivot portion 516 of the solenoid bracket 514 as depicted in FIG. 11. The cover bolt nuts are advantageously threaded inside and are positioned to align with apertures on the solenoid bracket pivot portion 576.

The solenoid bracket 514 also has a pivot 536 positioned along the pivot portion 576 of the solenoid bracket 514. In the present embodiment, the pivot 536 is made from a narrow flange with a thru-hole sized to accept a pivot bolt 537 (FIG. 8). The pivot is also facilitated with a pivot nut 539 (FIG. 12) fixed to the solenoid bracket 514 as depicted in FIG. 12. The pivot nut 539 is adapted to receive the threads of the pivot bolt 537. An aperture through the pivot nut 539 aligns with an aperture through the pivot 536. In the present embodiment, the pivot nut 539 has internal threads.

Installation of the retrofit switch actuator is simple. First, the solenoid bracket 514 is attached to the wall panel 106 of the circuit breaker control-system. The solenoid bracket 514 is installed by loosening the switch mounting bolts 108, 110, 554 (possible others not shown) to allow insertion of the mounting portion 574 of the solenoid bracket 514 between the wall panel 106 and the switch mounting plate 104. The elongated slot 572 and the shorter slots 568, 570 in the solenoid mounting bracket 514 are configured to accept the mounting bolts 110, 108, 554 and the control switch shaft 113 as the mounting portion 574 of the solenoid bracket 514 is slid between the mounting plate 104 and the wall panel 106. The mounting bolts 110, 108, 554 are then tightened to firmly secure the solenoid mounting plate 574 sandwiched between the switch mounting plate 104 and the wall panel 106.

The pistol grip 102 of the circuit breaker control switch 112 is temporarily removed from the control shaft 113 to allow the adapter 700 to be slid over the control shaft 113. In the present embodiment, the control switch shaft 113 is square. Accordingly, the square thru-hole 708, depicted in FIG. 9, accepts the control switch 113. After the adapter 700 is positioned over the shaft 113, the pistol grip 102 is replaced upon the control shaft 113 distal of the adapter 700. The adapter 700 is positioned with the lever arm 704 directed toward the axis of the solenoid armature 524.

The solenoid has a mounting plate 534 which couples to the back of the solenoid via bolts 530, 532 as in the previous embodiment. The mounting plate has a pivot sleeve 565 aligned along an edge of the mounting plate 534, as illustrated in FIG. 7. The solenoid is positioned such that the sleeve 565 is aligned between the pivot flange 536 and the pivot nut 539. The pivot bolt 537 passes through the pivot flange 536, through the sleeve 565 and threads into the pivot nut 539. In one advantageous embodiment, nylon or other composite washers can be positioned between the pivot flange 536 and the pivot sleeve 565, and between the pivot nut 539 and the sleeve 565 to provide for easy rotation of the solenoid about the pivot point.

A solenoid armature clip 526, as in the previous embodiment, is then adjusted so that it aligns the lever arm 704. The solenoid clip 526 is connected to the lever arm 704 via a clip fixing bolt 710 and a bushing 711 with a bore through its center sized to receive the clip fixing bolt 710. The bushing is positioned between the arms of the armature clip 526 and through the thru-hole 710 of the lever arm. Advantageously, this bushing is made of nylon or other low friction material such as graphite such that the lever arm 704 pivots at the thru-hole 710 about the bushing 711. Other materials, such as metals, plastic and the like, are also suitable. This attachment is best shown in FIG. 7.

The pistol grip handle 102 is replaced such that the adapter 700 is mounted onto the control shaft 113 sandwiched between the pistol grip handle 102 and the switch mounting plate 104.

A switch actuator cover 562 is attached to the solenoid bracket 514. The cover protects both the solenoid 520 and its linkage to the circuit breaker control switch 112. The solenoid 520 is housed within the solenoid bracket 514 and cover 562. Cover bolts 566, 567 (FIG. 8) attach to the underside of the solenoid bracket 514 and secure the cover 562 to the solenoid bracket 514. Preferably, to allow hand clearance while turning the pistol grip 102, the cover 562 is recessed in the area of the pistol grip 102.

As illustrated in FIG. 8, a solenoid control panel 540 is mounted to the solenoid bracket 514. The solenoid control panel 540 is similar to the panel described in connection with the first embodiment of the present invention. The solenoid control panel 540 includes a power signal line 548, a ground signal line 546, and open and close signal lines 542, 544, respectively. Signal lines 550 link the solenoid control panel 540 to the cylindrical portion 522 of the solenoid that houses a coil (not shown). Signal lines 551 connect the control panel to the control system 147.

The switch actuator front mounted in accordance with a second embodiment of the present invention functions similarly to the rear mounted switch actuator. The present invention allows the remote actuation of the control switch from a main monitoring station. The control panel receives signals from the control system 147 and operates the solenoid consistently with the control signals. The solenoid causes the solenoid output shaft and the armature clip to move in either direction along its axis. The movement of the armature clip causes the adapter 700 to rotate about the axis of the shaft 113. The rotation of the control shaft 113 mechanically engages the control switch 112. A circuit breaker reacts to the control switch 112, just as if the pistol grip had been manually turned. In addition, the pistol grip handle 102 can still be used for manual actuation.

Although the particular embodiments of the present invention have been described and illustrated above, those skilled in the art will appreciate that various changes and modifications can be made to the present invention without departing from its spirit. Accordingly, the scope of the present invention is defined only by the following appended claims.

What is claimed is:

1. A switch actuator for a circuit breaker control switch, said circuit breaker control switch having a rotatable control shaft said switch actuator comprising:

a solenoid having an axially movable output shaft; and an adapter rotatably mounted on one end to the axially movable output shaft of said solenoid and adapted to be fixedly mounted on the other end to said rotatable control shaft such that the adapter converts axial movement of said solenoid output shaft into rotational motion of the control shaft, the adapter further comprising:

a first opening, the size of said opening large enough to accommodate the control shaft of said circuit breaker control switch; and a second opening oriented parallel to said first opening, said second opening providing for attachment between said adapter and said solenoid.

2. The switch actuator of claim wherein said adapter further comprises:

a cylindrical opening on said adapter through which a tightening connector can be inserted; and a slit located along a cross-section of said cylindrical opening, said slit configured to contract with force exerted on said tightening connector.

3. A retrofit switch actuator for a circuit breaker control switch in a power distribution network, said circuit breaker control switch having a control shaft movable from a first position to a second position, said actuator comprising:

a solenoid having an axially movable output shaft;

means for coupling the output shaft of said solenoid to said control shaft of said circuit breaker control switch and for moving said control shaft from said first position to said second position in response to movement of the solenoid output shaft, and a solenoid bracket to which said solenoid is pivotably connected.

4. A retrofit actuator for a circuit breaker control switch in a power distribution network said circuit breaker control switch having a control shaft movable from a first position to a second position, said actuator comprising:

a solenoid having an output shaft movable from at least a first solenoid position to a second solenoid position:

a coupler attached to the output shaft of said solenoid and adapted to be coupled to said control shaft, such that movement of said output shaft from said first solenoid position to said second solenoid position results in movement of said control shaft from said first position to said second position;

a control panel electrically linked to said solenoid; and a solenoid bracket to which said solenoid is pivotably connected.

5. The switch actuator of claim 4, further comprising a cover attached to said solenoid bracket that covers said solenoid.

* * * * *